US010569320B2

(12) United States Patent
Nobles

(10) Patent No.: US 10,569,320 B2
(45) Date of Patent: Feb. 25, 2020

(54) ANGLE-INDICATING TUBE BENDER APPARATUS, SYSTEM, AND METHOD

(71) Applicant: WAHOO INNOVATIONS, INC., Farmville, NC (US)

(72) Inventor: Robert Lee Nobles, Farmville, NC (US)

(73) Assignee: WAHOO INNOVATIONS, INC., Farmville, NC (US)

( * ) Notice: Subject to any disclaimer, the term of this patent is extended or adjusted under 35 U.S.C. 154(b) by 398 days.

(21) Appl. No.: 15/314,954

(22) PCT Filed: Jun. 1, 2015

(86) PCT No.: PCT/US2015/033453

§ 371 (c)(1),
(2) Date: Nov. 30, 2016

(87) PCT Pub. No.: WO2015/184432

PCT Pub. Date: Dec. 3, 2015

(65) Prior Publication Data

US 2017/0095849 A1 Apr. 6, 2017

Related U.S. Application Data

(60) Provisional application No. 62/004,954, filed on May 30, 2014.

(51) Int. Cl.
*B21D 7/14* (2006.01)
*B21D 7/02* (2006.01)

(52) U.S. Cl.
CPC ..... *B21D 7/14* (2013.01); *B21D 7/02* (2013.01)

(58) Field of Classification Search
CPC ... B21D 7/14; B21D 7/16; B21D 7/12; B21D 7/02
See application file for complete search history.

(56) References Cited

U.S. PATENT DOCUMENTS

| | | | | |
|---|---|---|---|---|
| 5,144,823 | A * | 9/1992 | Wood | B21D 7/063 33/366.21 |
| 5,669,258 | A | 9/1997 | Luebke | |
| 5,836,188 | A | 11/1998 | Mahan et al. | |
| 6,708,541 | B1 | 3/2004 | Matsumoto et al. | |
| 6,980,880 | B1 | 12/2005 | Ramsey | |
| 2005/0262911 | A1 | 12/2005 | Dankowicz et al. | |
| 2008/0087065 | A1 | 4/2008 | Hainzinger | |
| 2009/0249851 | A1 | 11/2009 | Isaacs | |
| 2015/0033813 | A1* | 2/2015 | Leclerc | B21D 7/14 72/37 |

* cited by examiner

*Primary Examiner* — Debra M Sullivan
(74) *Attorney, Agent, or Firm* — Nexsen Pruet, LLC; E. Eric Mills

(57) ABSTRACT

An angle-indicating tube bender apparatus, system, and method is disclosed. Namely, the presently disclosed subject matter provides a tube bender comprising an angle indicator device that is used to measure and indicate the angle of the tube during the bending process. The angle indicator device can be, for example, a digital protractor, digital angle gauge, or digital angle locator. Further, the tube bender may comprise laser technology that is used to project guiding lines or markers from the bender head for guiding the user. In one example, the guiding lines or markers are projected in a crosshair beam pattern that can be used to ensure the accuracy of one bend with respect to another bend.

17 Claims, 23 Drawing Sheets

ANGLE-INDICATING TUBE BENDER APPARATUS, SYSTEM, AND METHOD

CROSS REFERENCE TO RELATED APPLICATIONS

This application is a 35 U.S.C. § 371 U.S. national phase entry of International Application No. PCT/US2015/033453 having an international filing date of Jun. 1, 2015, which claims the benefit of U.S. Provisional Patent Application No. 62/004,954 filed May 30, 2014, each of which is incorporated herein by reference in its entirety.

TECHNICAL FIELD

The presently disclosed subject matter relates generally to conduit, pipe, or tube benders and more particularly to an angle-indicating tube bender apparatus, system, and method.

SUMMARY

An angle-indicating tube bender apparatus, system, and method of using the same is provided. In some embodiments, the apparatus includes a tube bending portion and an angle indicator device, wherein the tube bending portion includes a head, a curved cradle with a receiving end configured to receive and engage a tube or conduit to be bent, and a handle. The angle indicator device may also include a display for displaying the measured angle, user controls configured to receive an input from a user of a desired bend angle, control electronics for operating the same (including one or more of a communications interface, a controller, and/or data storage), and an angle alert mechanism. The angle alert mechanism may include one or more of a speaker, light source, or vibration source that alert the user that a desired bend angle has been reached. The apparatus may also include a housing having the angle indicator device housed therein. In some embodiments, the housing includes one or more openings for accessing the angle indicator device and/or the display or user controls thereon.

In some embodiments, the apparatus also includes a guideline projection mechanism configured to project guidelines for aiding a user in alignment of the tube or conduit to be bent. The guideline projection mechanism may include, for example, one or more lasers configured to project the guidelines. The guidelines may be projected in cross-hair pattern in some examples, or other alignment patters in others.

In addition, the present disclosure includes a method of using an apparatus like that discussed in part above. The method may include, but is not limited to, the steps of providing the apparatus to a user, inserting a tube or conduit to be bent into a tube-bending portion of the apparatus, bending the tube or conduit to be bent while the angle indicator device displays a bend angle in real time, continuing to bend the tube or conduit to be bent until the angle indicator device displays a desired bend angle, and ceasing bending operations upon reaching the desired bend angle.

In some embodiments, the method further includes the steps of a user entering a desired bend angle into the angle indicator device, and the angle indicator device triggering an angle alert upon reaching the desired bend angle. The alert may include an audible alert, a visual alert, and/or a tactile alert. The method may also include storing information about bend events for later use by the user. In addition, information about the bend events may be communicated through a communications interface to one or more local computing devices, and further may be communicated through the one or more local computing devices to a remote server (e.g., a cloud-based server) via a network.

BACKGROUND

Pipe benders have long been used, for example, by electricians to bend piping (i.e., conduit) through which electrical wires pass. Such pipe benders, as is known, include a curved bending head or cradle that receives the pipe to be bent, and a handle which can be grasped by the user. To bend the pipe, the user simply places the pipe in the head, and pivots the head using the handle to bend the pipe. The pipe is bent around the curvature of the cradle until the desired angle of bend is reached.

When the user bends a pipe, he/she tries to achieve a particular angle, typically 45° or 90°. However, other size angles are often required. If a pipe is not bent to the desired angle (i.e., if the angle is overshot or undershot), then the pipe will not lay were desired, and the pipe may not lay flush against a surface, for example. To bend the pipe to the desired angle, users must currently bend the pipe to an approximate angle relying solely on eye sight, experience, and other approximation tools. Therefore, new approaches are needed for ensuring the desired bend angle when using pipe benders to bend piping.

BRIEF DESCRIPTION OF THE DRAWINGS

Reference will now be made to the accompanying Drawings, which are not necessarily drawn to scale, and wherein.

DETAILED DESCRIPTION

The presently disclosed subject matter now will be described more fully hereinafter with reference to the accompanying Drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

In some embodiments, the presently disclosed subject matter provides an angle-indicating tube bender apparatus, system, and method. Namely, the presently disclosed subject matter provides a tube bender that includes an angle indicator device used to measure and indicate the angle of the bend in the tube during the bending process. The angle indicator device can be, for example, a digital protractor, digital angle gauge, or digital angle locator.

Further, the tube bender may include laser technology that is used to project guiding lines or markers from the bender head for guiding the user. In one example, the guiding lines or markers are projected in a crosshair beam pattern that can be used to ensure the accuracy of one bend with respect to another bend.

In other embodiments, the presently disclosed angle-indicating tube bender apparatus may include electronics for creating a record of work performed (i.e., bending operations) and for communicating with other devices, such as local computers or networked computers. Namely, tube bender systems are provided for collecting information about bending operations that are performed using the presently disclosed angle-indicating tube bender apparatus.

Figure 1:
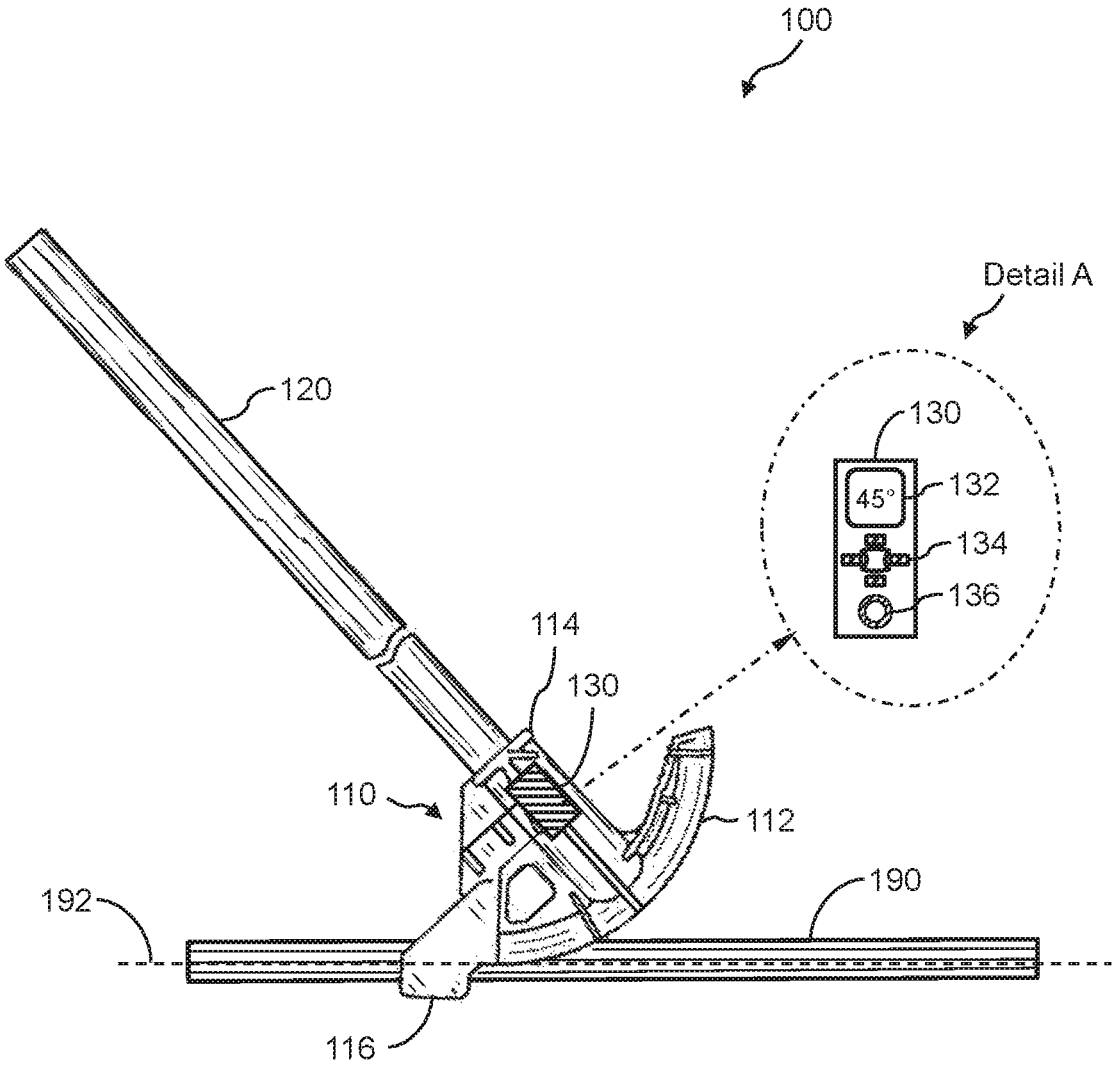
FIG. 1 illustrates a side view of the presently disclosed angle-indicating tube bender at a starting position with respect to the tube to be bent.

Referring now to FIG. 1, a side view of the presently disclosed angle-indicating tube bender 100 is shown, wherein the tube bender 100 includes an angle indicator device at a starting position with respect to the tube to be bent; for example, with respect to a conduit 190. The angle-indicating tube bender 100 may include a head 110 having a curved cradle 112 (aka, the shoe) and may further include a stem 114 extending up from the cradle 112. A handle 120 can be removably received in the stem 114 and can be grasped by a user (e.g., an electrician) to pivot the head 110 in order to bend a tube as is known. In certain other embodiments, the head 110, stem 114, and handle 120 may be non-removably coupled to one another. The cradle 112 typically includes a receiving end 116 for engaging with (e.g., hooking around) the tube to be bent. The angle-indicating tube bender 100 may further include an angle indicator device 130 that is integrated into, or otherwise attached to, the head 110 and/or the handle 120 of the angle-indicating tube bender 100.

Figure 2:
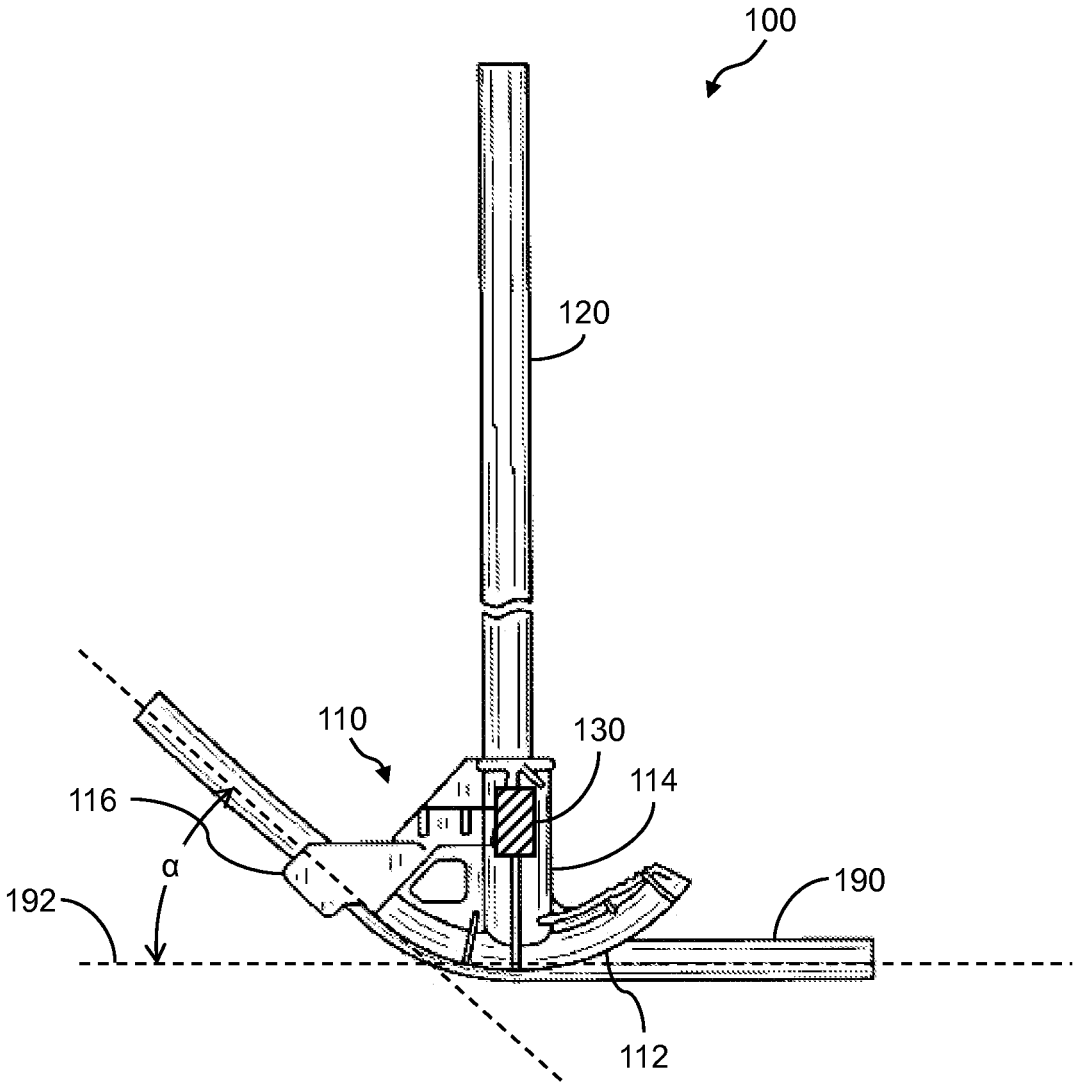
FIG. 2 illustrates a side view of the presently disclosed angle-indicating tube bender in the process of bending the tube to a desired angle.

FIG. 1 shows the angle-indicating tube bender 100 at a starting position with respect to the tube to be bent, which may be, for example, the conduit 190. Further, FIG. 2 shows the angle-indicating tube bender 100 in the process of bending the conduit 190 to a desired angle $\alpha$ with respect to a plane 192. The plane 192 is the plane that coincides with the center axis of the unbent conduit 190 (shown in FIG. 1). In FIG. 1, the angle $\alpha$ is considered to be at 0 degrees, whereas in FIG. 2 the angle $\alpha$ is greater than 0 degrees (e.g., 30, 45, 90 degrees).

The angle indicator device 130 may include any technology capable of measuring and indicating an angle for the purpose of indicating the degree of bending of the conduit 190 using the angle-indicating tube bender 100. Namely, any technology capable of measuring and indicating the angle $\alpha$.

In one example, the angle indicator device 130 can be a separate device that is mechanically fastened to the head 110 and/or the handle 120 of the angle-indicating tube bender 100 (such as to retrofit an existing tube bender with manual visual angle indicator lines). Examples of such devices include, but are not limited to, any commercially available digital protractor or digital angle gauge or digital angle locator, an accelerometer, an inertial measurement unit (IMU), an inclinometer, a tilt sensor, and the like. Examples of commercially available digital protractors or angle gauges include the Digital Protractors available from Measurement Supply Company (Tampa, Fla.), the WR300 Wixey™ Digital Angle Gauge available from Wixey, the GemRed Digital Bevel Box and GemRed Digital Protractors available from Axminster Tool Centre Ltd (UK), and the digital angle locators available from Johnson Level & Tool Mfg. Co., Inc. (Mequon, Wis.).

In another example, the angle indicator device 130 can be integrated into the head 110 or the handle 120 of the angle-indicating tube bender 100 at manufacture. In this example, the angle indicator device 130 can be, for example, an accelerometer, an IMU, an inclinometer, a tilt sensor, and the like.

Referring now to a Detail A of FIG. 1, the angle indicator device 130 can include, for example, a digital display 132, any types of user controls 134, an audio output 136, any types of visual indicators, such as LEDs (not shown), data storage (not shown), a processor (not shown), a wired or wireless communications interface (not shown), and the like.

The digital display 132 can be used to display the current angle $\alpha$, any stored values of angle $\alpha$, certain device settings, and/or any other information. Preferably, the digital display 132 is oriented for easy viewing when the angle-indicating tube bender 100 is in use. The user controls 134 can be, for example, push buttons, such as an ON/OFF button, a ZERO button, a SET button, UP and DOWN arrow buttons, and the like. Alternatively, the digital display 132 can be a touchscreen and the user controls are provided on the touchscreen. The audio output 136 can be a speaker that is used to emit an audible tone or signal. Other types of indicators may be provided, such as, for example, a tactile indicator that provides vibration in the handle 120.

In one example method of using the presently disclosed angle-indicating tube bender 100 comprising the angle indicator device 130, the user enters the desired bending angle α using user controls 134. In one example, the user enters 38 degrees. Then, the user engages the conduit 190 into the receiving end 116 of the cradle 112 and resets the angle indicator device 130 by pressing the ZERO button. Then the user begins bending the conduit 190 through operation of tube bender 100 as is known. In real time, the angle indicator device 130 measures the angle α and displays the current angle α to the user via the digital display 132. When the user observes that the current angle α is at 38 degrees, he/she stops the bending operation. In another example, a beeping sound is generated via the audio output 136 when 38 degrees is reached, which prompts the user to stop the bending operation. In yet another example, a visual indicator (e.g., an LED) is turned on or the digital display 132 starts to blink when 38 degrees is reached, which prompts the user to stop the bending operation. Additionally, if the user intends to repeat the same bending operation, using user controls 134 the user may store a certain desired bending angle α, such as the 38 degrees. In another example, the angle indicator device 130 automatically stores the last angle entered or reached, thereby enabling the user to repeat bends having substantially the same angle.

Figure 3:
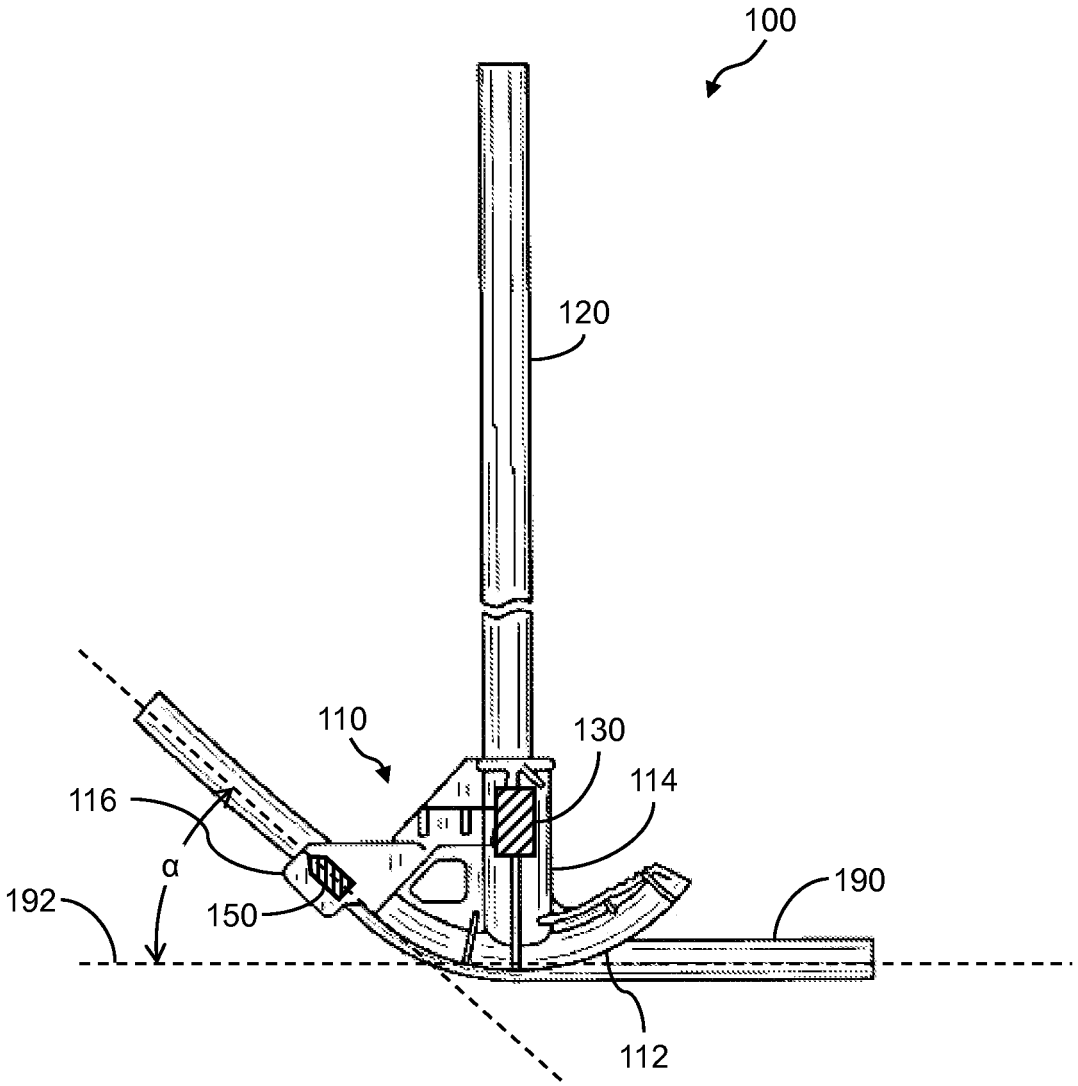
FIG. 3 illustrates a side view of the presently disclosed angle-indicating tube bender that further includes a guideline projection mechanism.

In other embodiments, in addition to the angle indicator device 130, the angle-indicating tube bender 100 can include capability to project guiding lines or markers for guiding the user. For example, FIG. 3 shows that the angle-indicating tube bender 100 further includes a guideline projection mechanism 150. For example, the angle-indicating tube bender 100 comprises a guideline projection mechanism 150 that is installed in relation to the receiving end 116 of the cradle 112. In one example, the guideline projection mechanism 150 uses laser technology to project two guiding lines or markers in a crosshair beam pattern, as further described with reference to FIG. 4 and FIG. 5.

Figure 4:
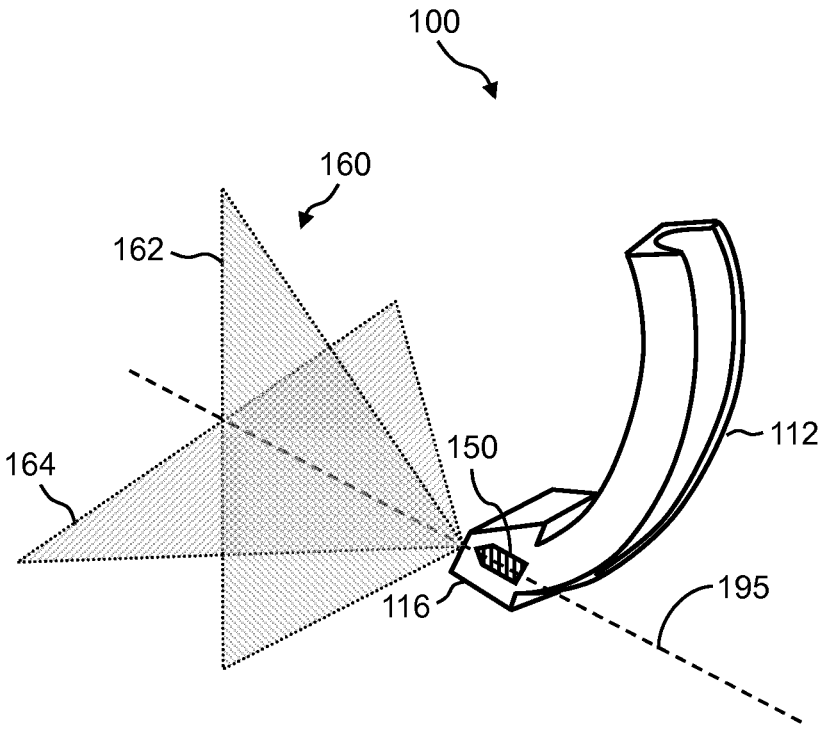
FIG. 4 and FIG. 5 illustrate a perspective view and an end view, respectively, of a portion of the head of the angle-indicating tube bender, wherein the angle-indicating tube bender comprises capability to project guidelines for guiding the user.
Figure 5:
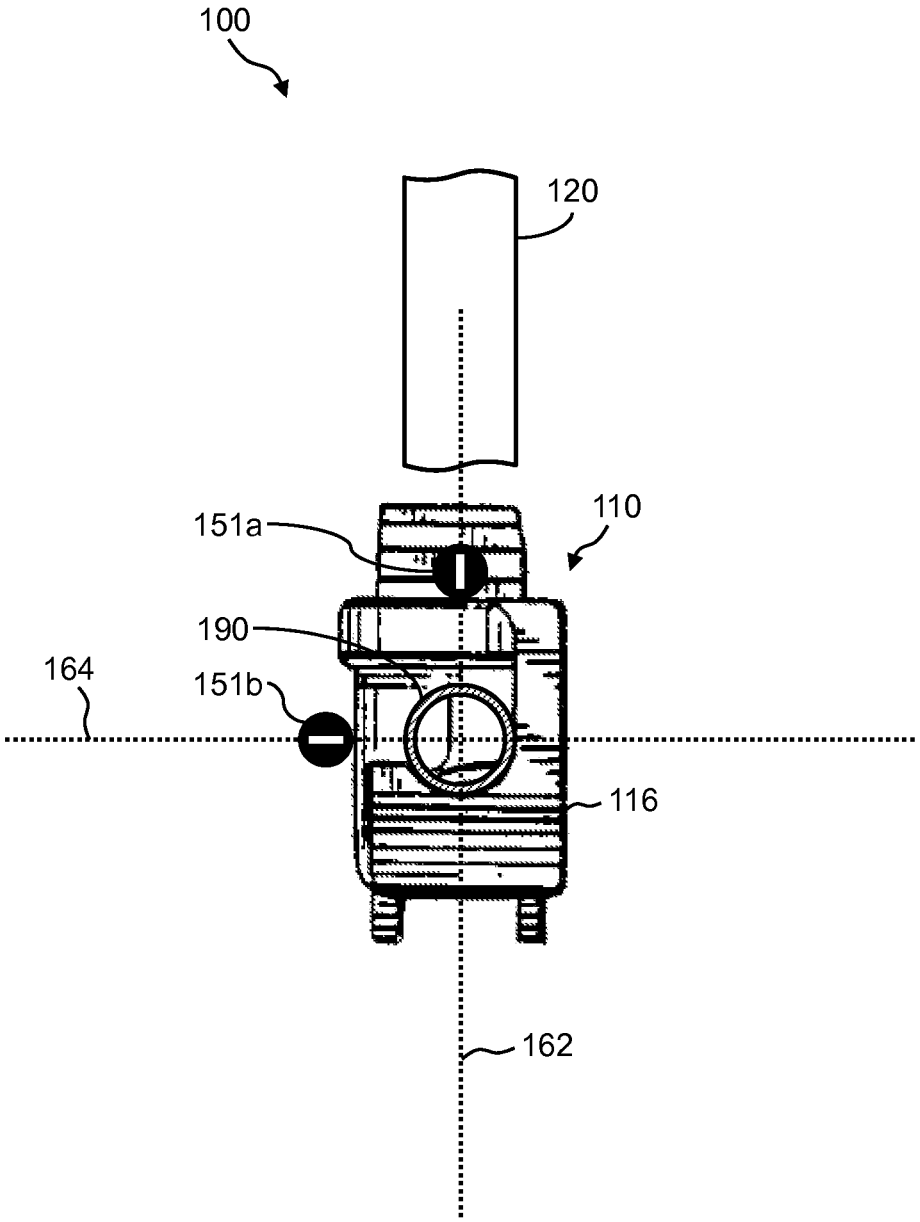

Referring now to FIG. 4 and FIG. 5, a perspective view and an end view, respectively, are shown of the cradle 112 of the head 110 of the angle-indicating tube bender 100, wherein the angle-indicating tube bender 100 includes the capability to project guiding lines or markers for guiding the user. For example, a crosshair beam pattern 160 includes a vertical beam 162 and a horizontal beam 164. The vertical beam 162 substantially aligns with the plane of the handle 120 of the angle-indicating tube bender 100. The horizontal beam 164 is substantially orthogonal to the vertical beam 162. The vertical beam 162 and the horizontal beam 164 project outward from the receiving end 116 of the cradle 112 of the head 110. FIG. 4 and FIG. 5 show that the unbent conduit 190 (shown in, for example, FIG. 1) has a center axis 195. The vertical beam 162 and the horizontal beam 164 intersect at every point along the center axis 195 of the unbent conduit 190.

Because the guideline projection mechanism 150 cannot, in some embodiments, be installed directly in line with the center axis 195 of the conduit 190, the guideline projection mechanism 150 typically includes two separate laser devices (e.g., laser devices 151*a*, 151*b*). For example, the laser device 151*a* may be mounted on the top of the cradle 112 with a vertically-oriented aperture to generate the vertical beam 162. The laser device 151*b* may be mounted on either side of the cradle 112 with a horizontally-oriented aperture to generate the horizontal beam 164.

One purpose of projecting the crosshair beam pattern 160 is to provide an accurate guide for orienting an existing bend in the conduit 190 with respect to the next bend to be made in the conduit 190. For example, the user rotates the conduit 190 such that the existing bend aligns with one of the beams of the crosshair beam pattern 160. In so doing, it is ensured that the next bend to be formed is accurately aligned with, or substantially 90 degrees out of phase with, the existing bend in the conduit 190. In other words, the crosshair beam pattern 160 may be used to ensure the accuracy of one bend with respect to another bend.

Referring again to FIG. 1 through FIG. 5, in some embodiments, the angle-indicating tube bender 100 includes the angle indicator device 130 alone, absent the guideline projection mechanism 150. However, in other embodiments, the angle-indicating tube bender 100 includes both the angle indicator device 130 and the guideline projection mechanism 150. More details of a specific instantiation of the presently disclosed angle-indicating tube bender are shown and described hereinbelow with respect to FIG. 6 through FIG. 20.

Figure 6:
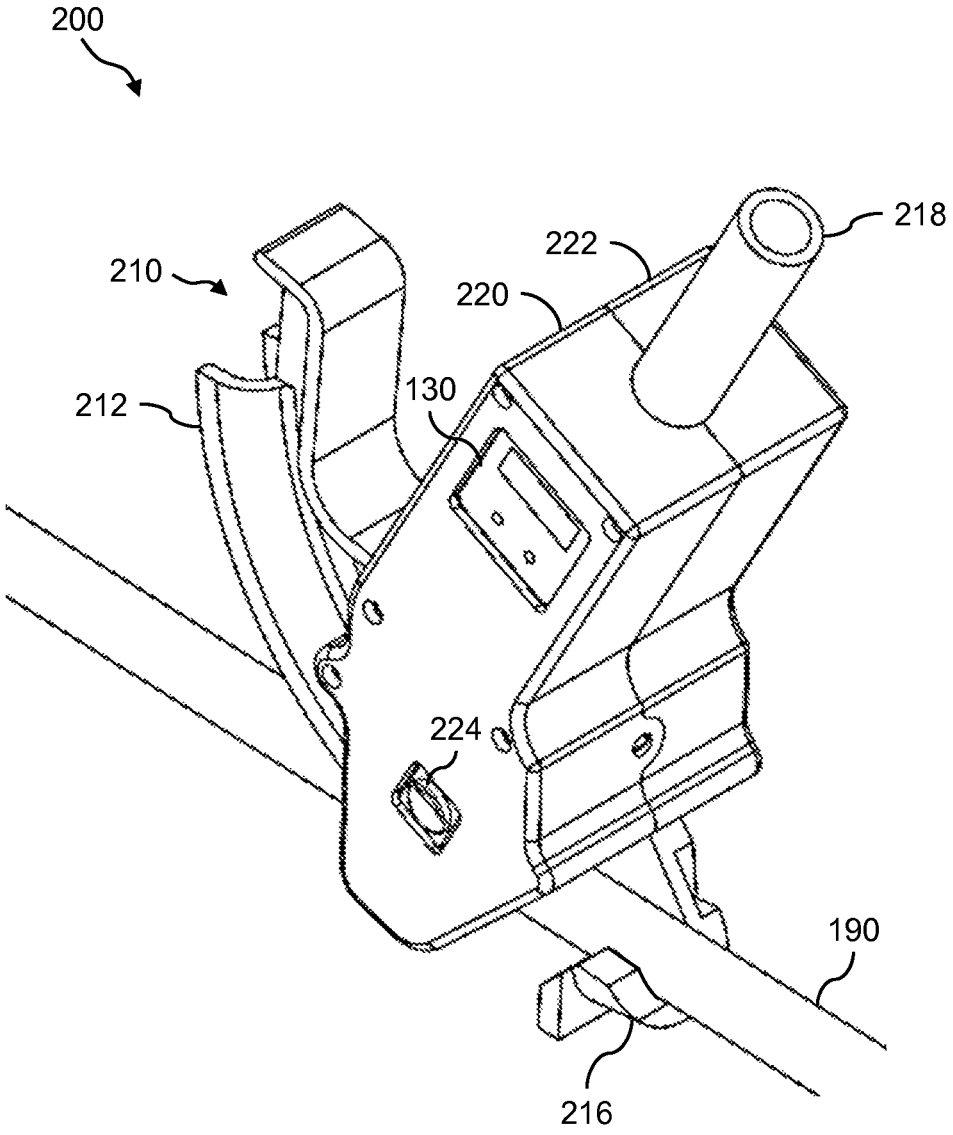
FIG. 6 illustrates a perspective view of an angle-indicating tube bender, which is an example instantiation of the presently disclosed angle-indicating tube bender and wherein the angle-indicating tube bender comprises a five-laser guideline projection mechanism.
Figure 7:
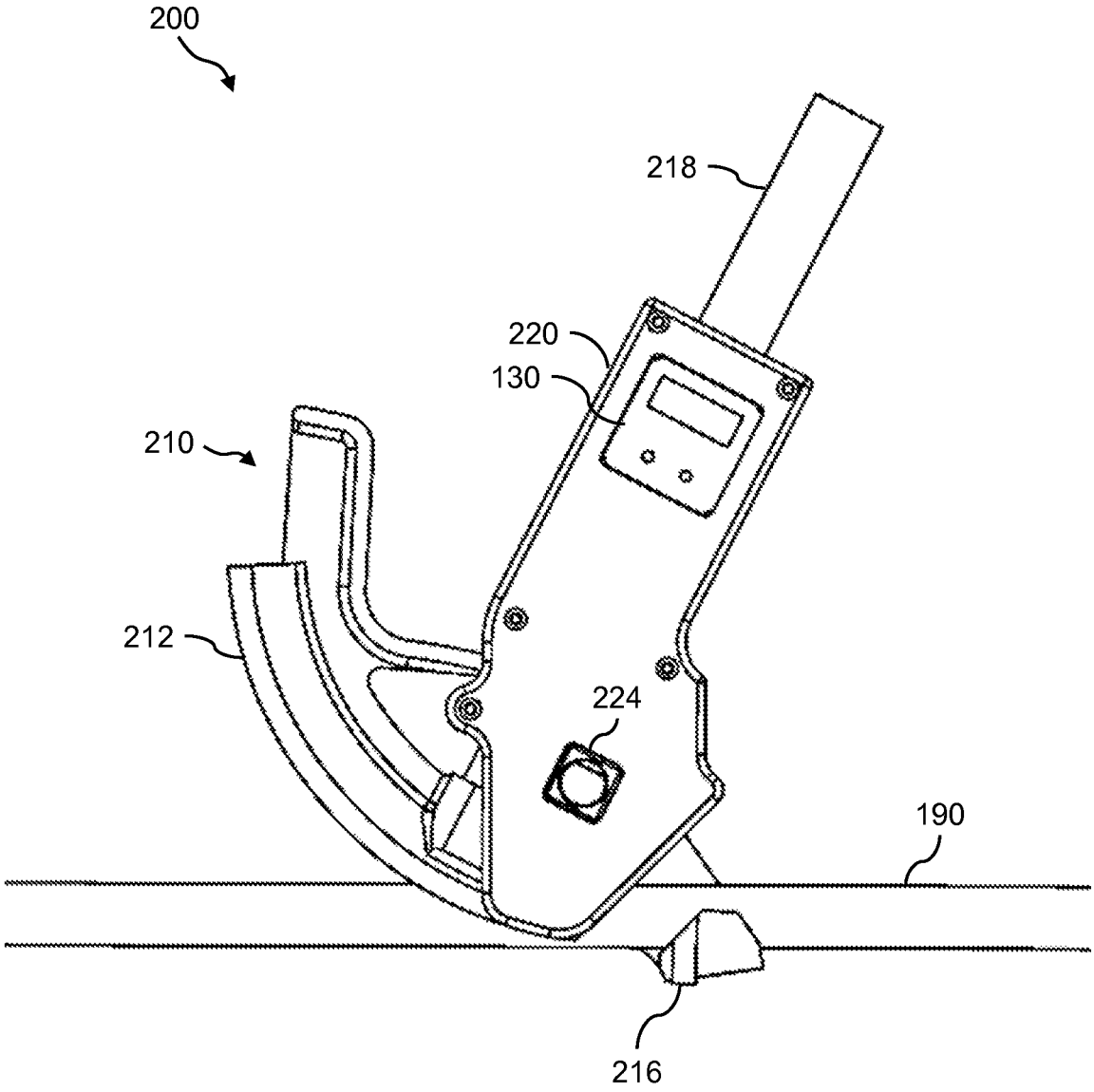
FIG. 7 and FIG. 8 illustrate side views of the angle-indicating tube bender shown in FIG. 6.
Figure 8:
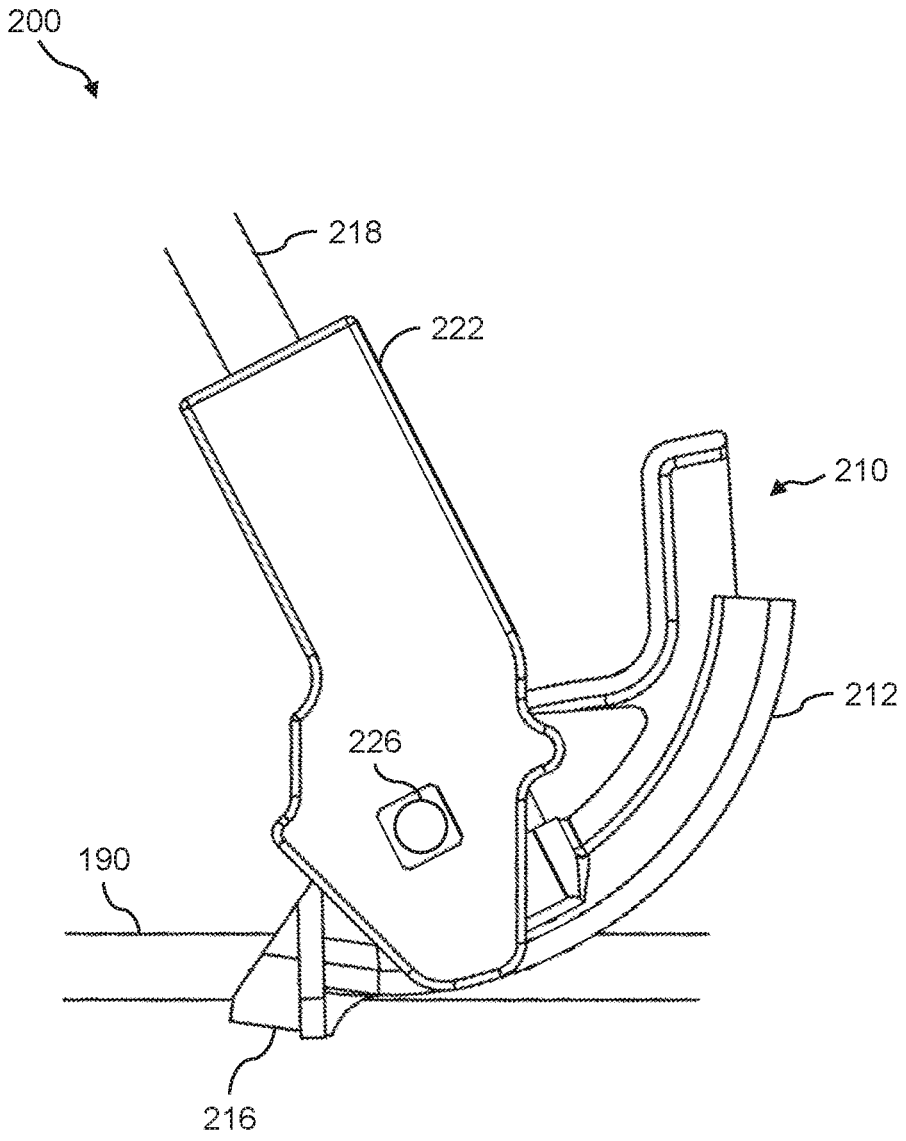
Figure 9:
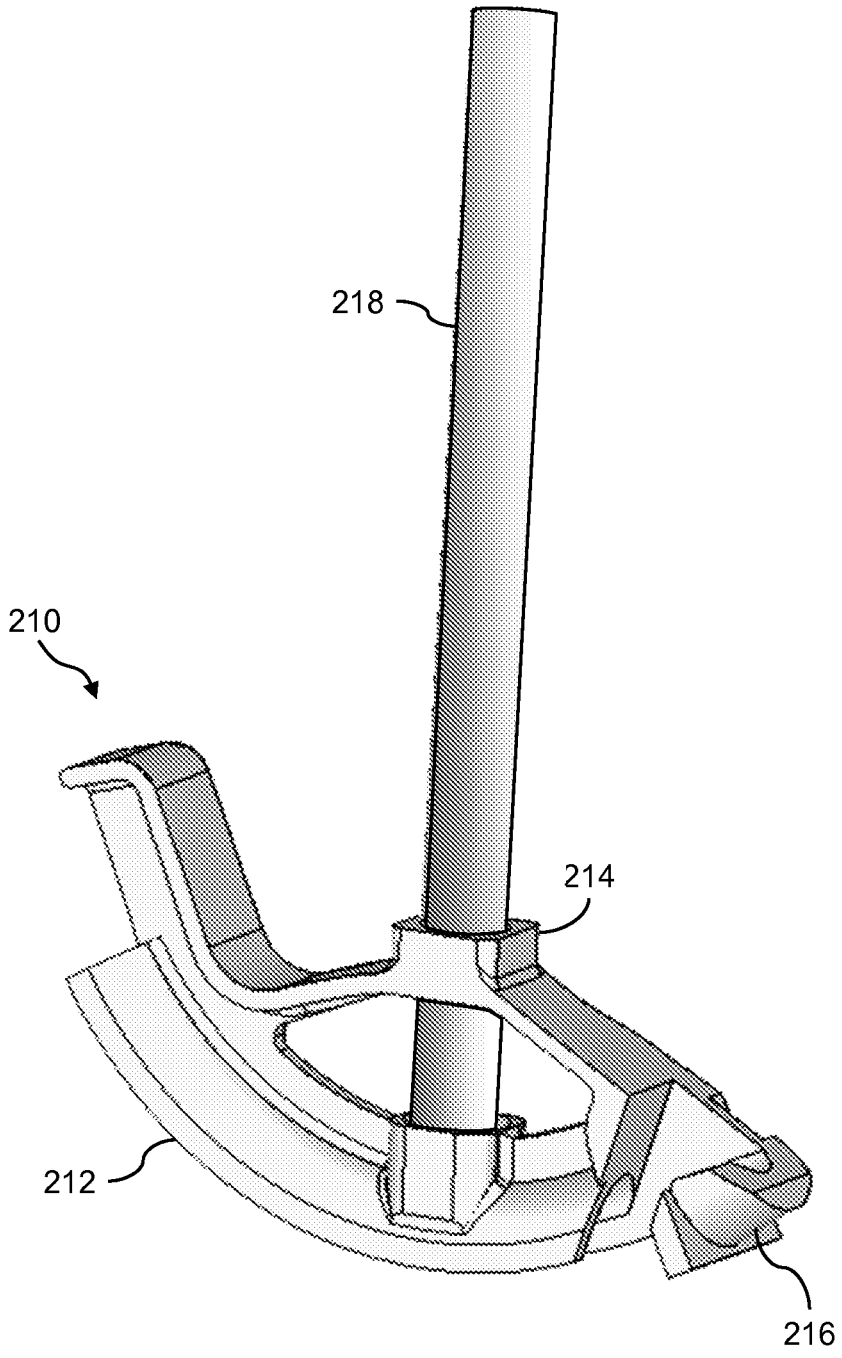
FIG. 9 through FIG. 15 show various views of the various components of the angle-indicating tube bender shown in FIG. 6 through FIG. 8.

Referring now to FIG. 6, a perspective view of an angle-indicating tube bender 200 is shown, which is an example of a specific instantiation of the presently disclosed angle-indicating tube bender and wherein the angle-indicating tube bender 200 comprises a guideline projection mechanism that projects five guidelines. Additionally, FIG. 7 and FIG. 8 show side views of the angle-indicating tube bender 200 shown in FIG. 6. Further, FIG. 9 through FIG. 16 show various views of the various components of the angle-indicating tube bender 200 shown in FIG. 6 through FIG. 8.

Referring now to FIG. 6 through FIG. 8, the angle-indicating tube bender 200 may include a head 210 having a curved cradle 212 (aka, the shoe) and a stem 214 (see FIG. 9) extending up from the cradle 212. A handle 218 may be removably received in the stem 214 and can be grasped by a user (e.g., an electrician) to pivot the head 210 in order to bend a tube as is known. In some embodiments the handle 218 may be non-removably coupled to the stem 214 and/or cradle 212. The cradle 212 may also include a receiving end 216 for engaging with (e.g., hooking around) the tube to be bent, such as conduit 190. An exemplary perspective view of the handle 218 installed in the head 210 is shown herein below with reference to FIG. 9.

Figure 10A:
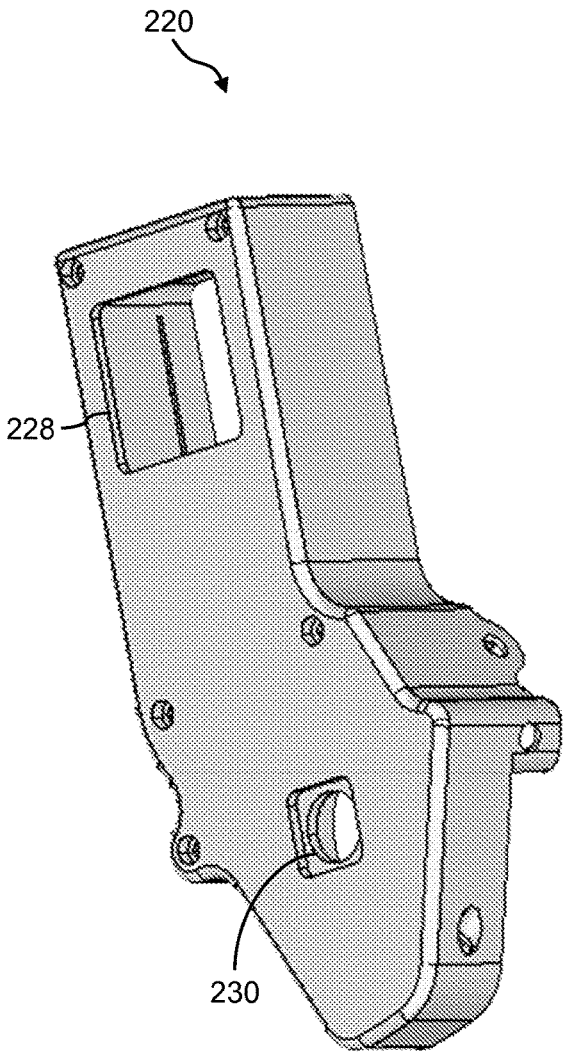
Figure 10B:
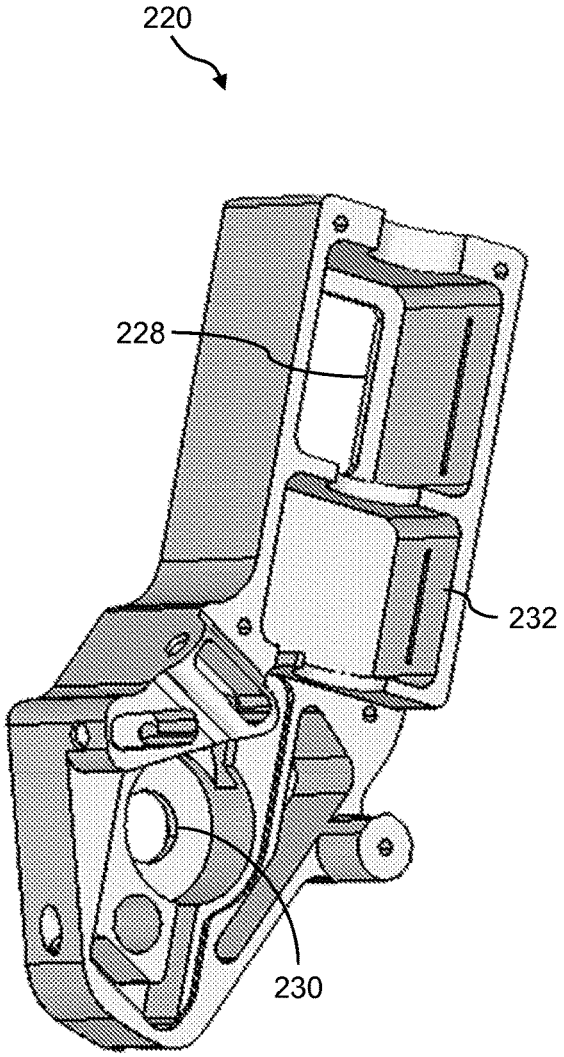
Figure 11A:
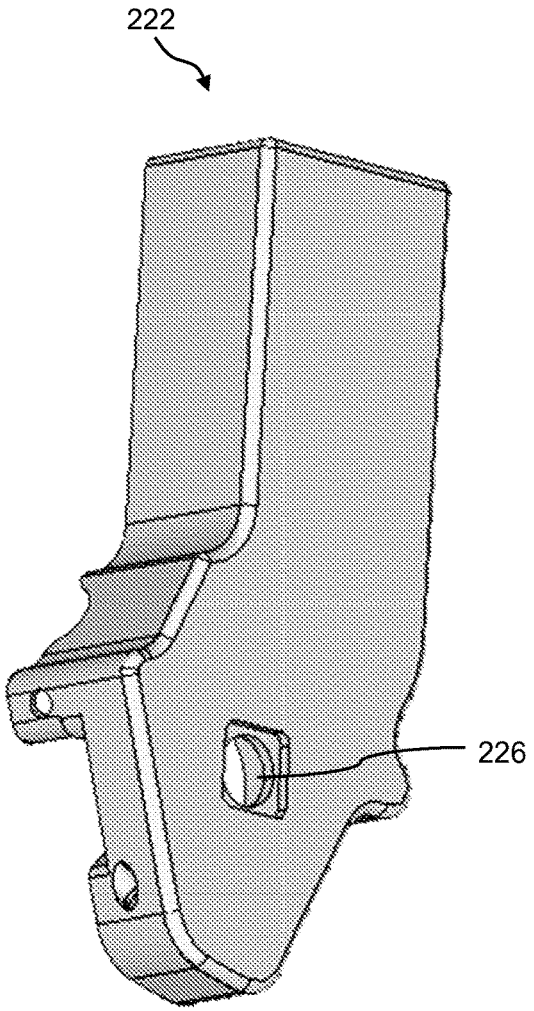
Figure 11B:
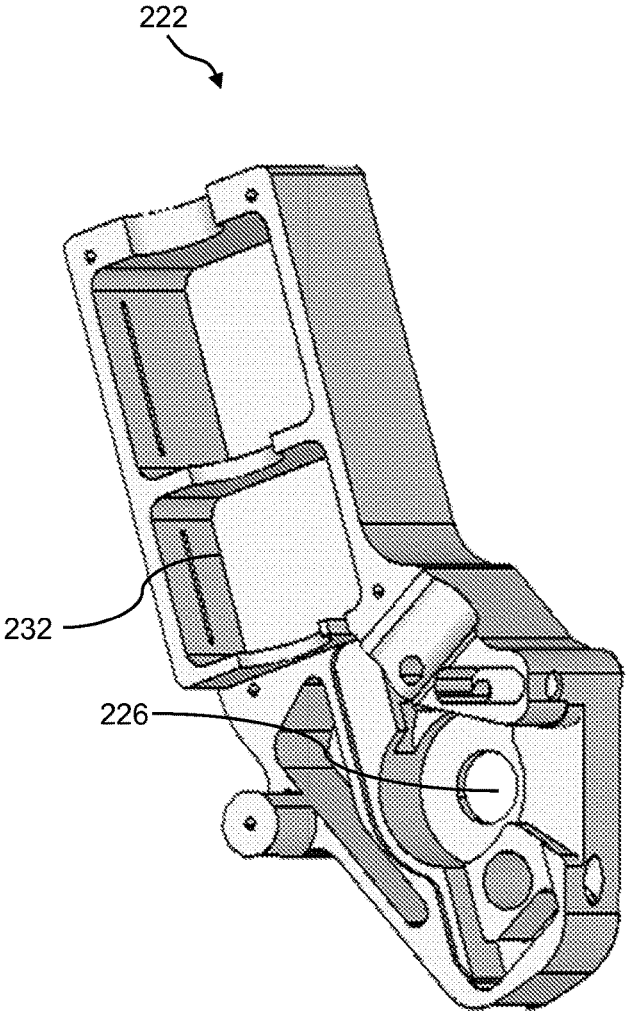

In some embodiments, the intersection of the cradle 212 and the handle 218 may be enclosed inside a two-piece housing. Namely, the two-piece housing may be formed of a housing portion 220 and a housing portion 222, wherein the housing portions 220, 222 are mated together along a center seam of the housing. The housing portions 220, 222 can be fastened together using, for example, screws, snaps, or other appropriate fastening means. The housing portions 220, 222 can be formed of any lightweight rigid material, such as, but not limited to, molded plastic and aluminum. FIG. 10A and FIG. 10B show outside and inside perspective views, respectively, of the housing portion 220. FIGS. 11A and 11B shows outside and inside perspective views, respectively, of the housing portion 222.

Figure 12A:
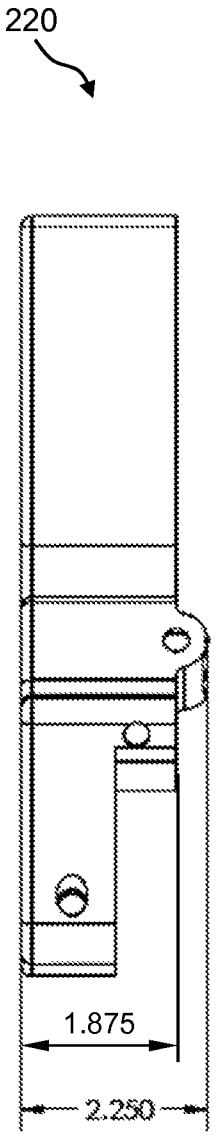
Figure 12B:
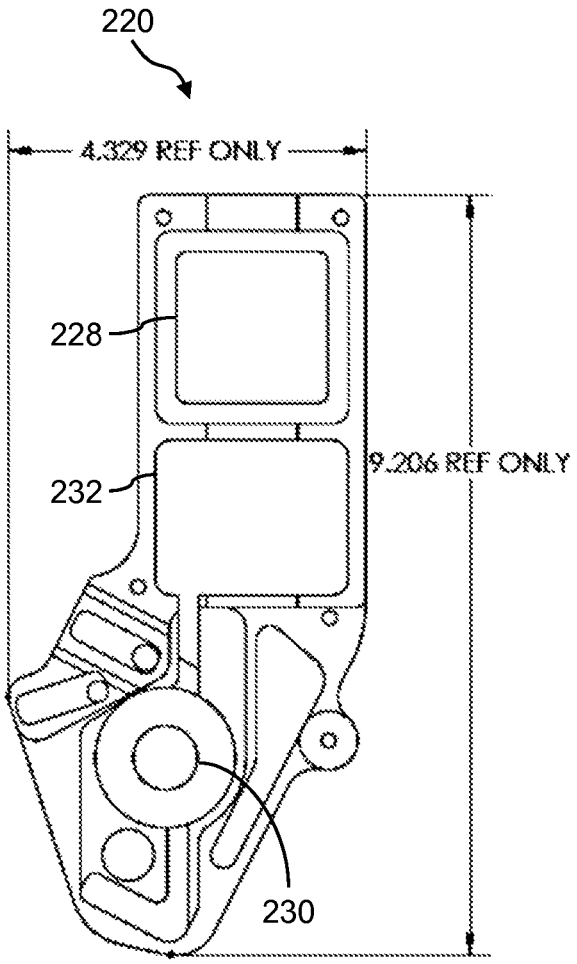

Further, FIG. 12A and FIG. 12B show a side view and a plan view, respectively, of the housing portion 220, wherein certain dimensions are indicated. In one example, the housing portion 220 has an overall length of about 9.206 inches, an overall depth of about 4.329 inches, and a width of about 1.875 inches. Accordingly, the angle-indicating tube bender 200 may have an overall length of about 9.206 inches, an overall depth of about 4.329 inches, and an overall width of about 3.75 inches.

The angle indicator device 130 and/or an ON/OFF switch 224 can be installed in any portions of the housing. In the example shown in FIG. 6 through FIG. 8, the angle indicator device 130 and the ON/OFF switch 224 are installed in the side of the housing portion 220. For example, FIGS. 10A and 10B, and FIGS. 12A and 12B, show that the housing portion 220 may include an opening 228 for receiving the angle indicator device 130 and an opening 230 for receiving the ON/OFF switch 224.

However, the angle indicator device 130 and the ON/OFF switch 224 can be installed in any one or more portions of the housing. In another example, the angle indicator device 130 may be installed the top of the housing portion 220 or in the top of the housing portion 222, while the ON/OFF switch 224 is installed in the side of the housing portion 220 or of the housing portion 222. In fact, FIG. 8 and FIG. 11A/11B show an opening 226 in the side of the housing portion 222 that could be used for ON/OFF switch 224 or any other type of user control.

Figure 13:
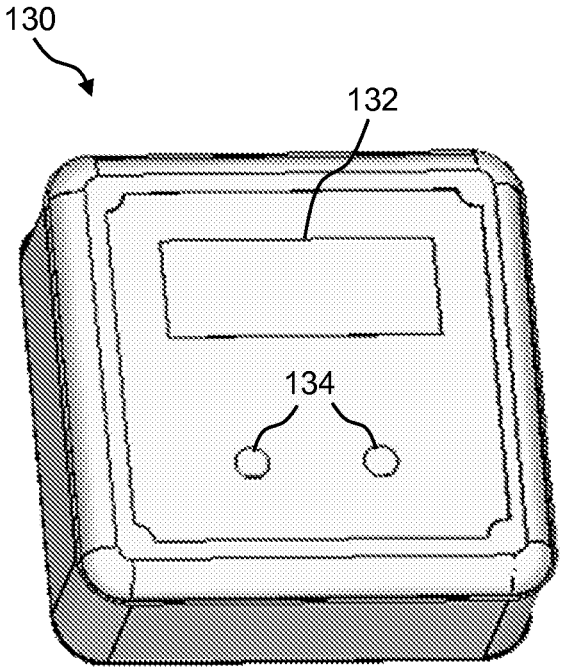

FIG. 13 shows a perspective view of an example of the angle indicator device 130 that includes the digital display 132 and the user controls 134.

Figure 14:
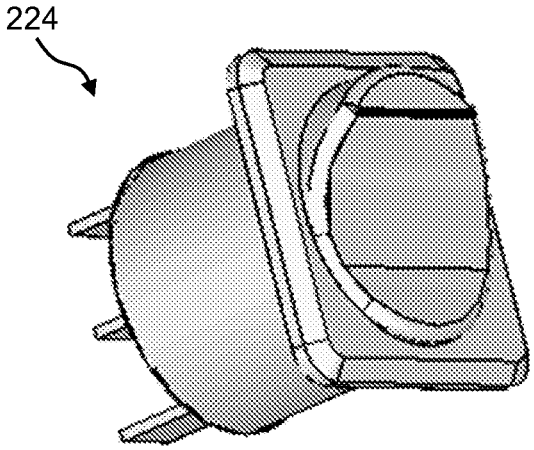

FIG. 14 shows a perspective view of an example of the ON/OFF switch 224, which in some embodiments may be a toggle switch.

Figure 15:
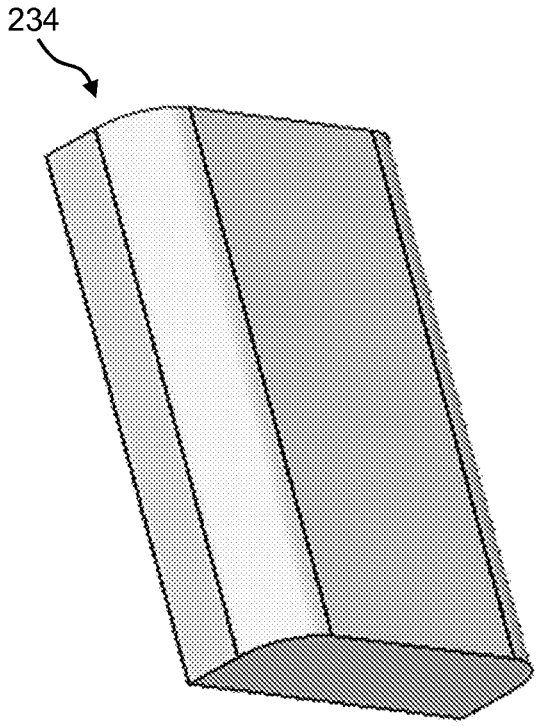

Further, a compartment 232 may be integrated into the housing portions 220, 222 of the angle-indicating tube bender 200, as shown in FIG. 10A/10B and FIG. 11A/11B. The compartment 232 may hold a battery or battery pack, such as a battery pack 234 that is shown in FIG. 15. The battery pack 234 can be used to power the angle indicator device 130.

Figure 16:
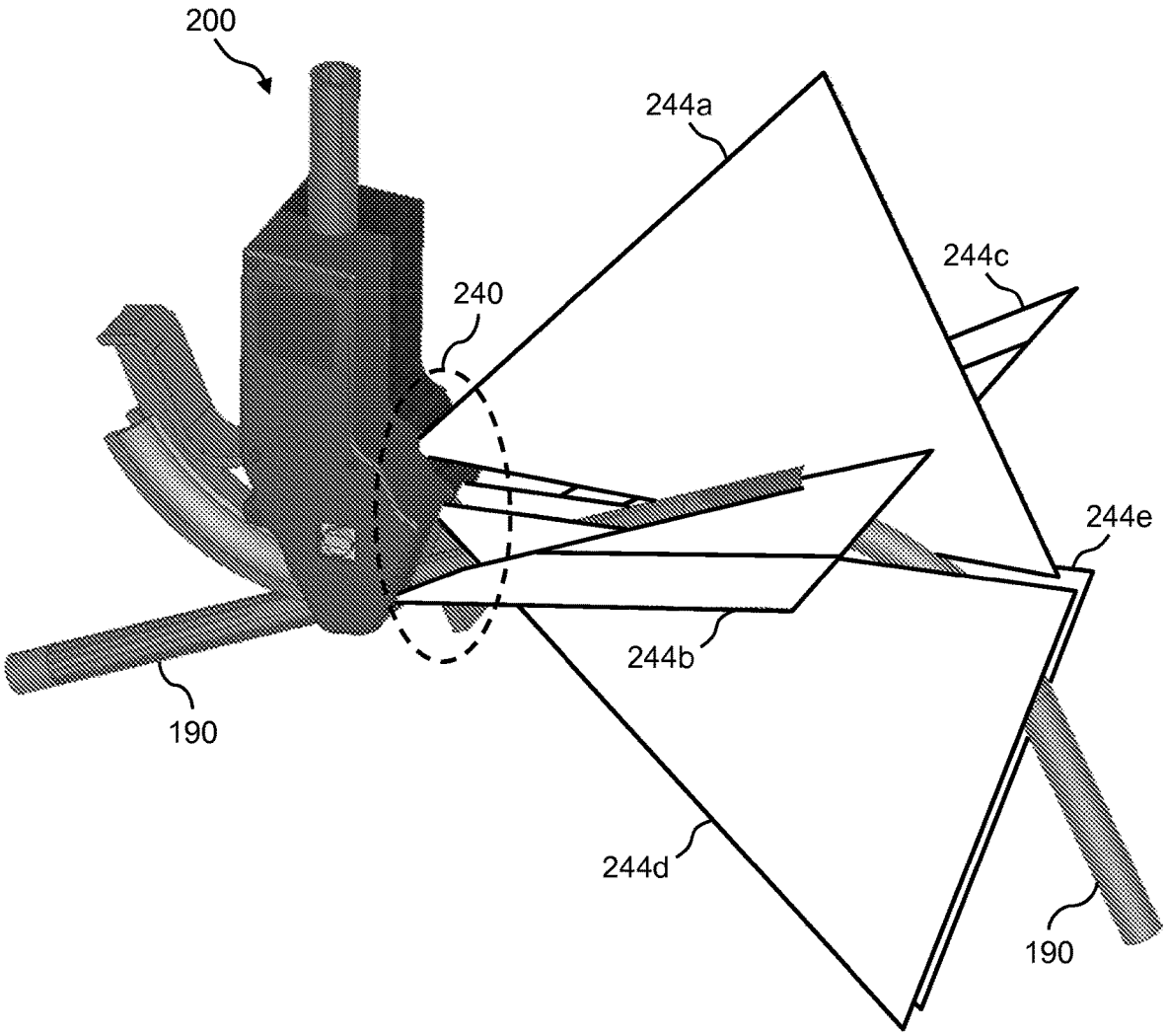
FIG. 16 and FIG. 17 show side perspective views of the angle-indicating tube bender shown in FIG. 6 through FIG. 8, wherein the angle-indicating tube bender includes a guideline projection system.
Figure 17:
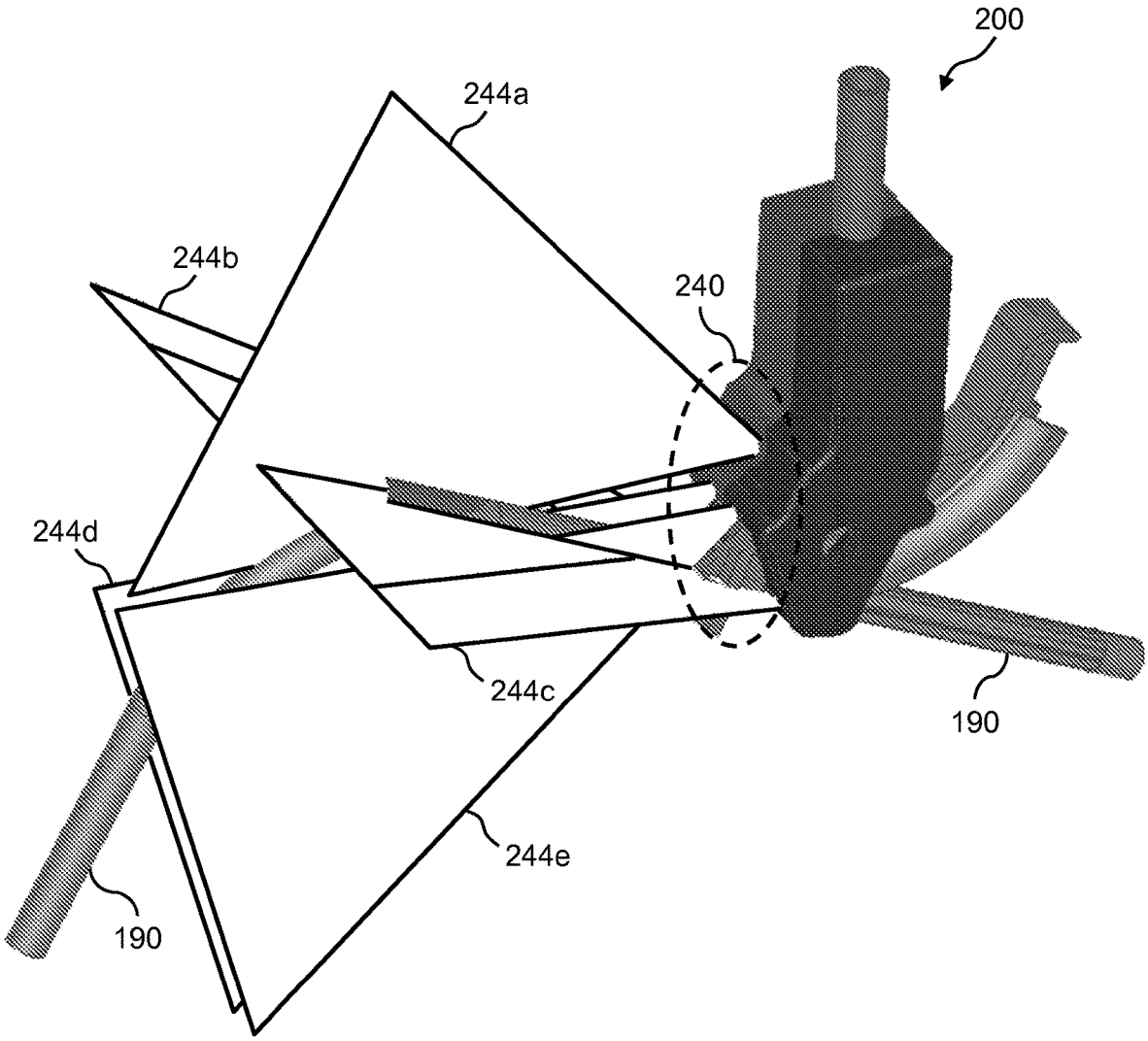
Figure 18:
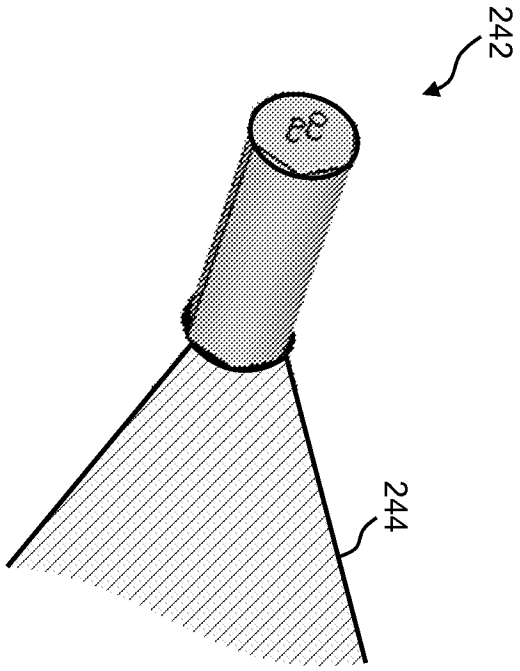
FIG. 18 shows a perspective view of an example of a laser device of the guideline projection system.

Referring again to FIG. 6 through FIG. 8, in some embodiments, the angle-indicating tube bender 200 includes the angle indicator device 130 alone, absent any mechanisms for projection guidelines. However, in other embodiments, the angle-indicating tube bender 100 includes both the angle indicator device 130 and a guideline projection mechanism. For example, FIG. 16 and FIG. 17 show side perspective views of the angle-indicating tube bender 200 shown in FIG. 6 through FIG. 8 that includes a 5-laser guideline projection system 240 for guiding the user. For example, five laser devices 242 may be installed in the housing portions 220, 222 of the angle-indicating tube bender 200. The battery pack 234 may supply power to the five laser devices 242. An example of one laser device 242 is shown in FIG. 18. The laser device 242 emits a laser beam 244. Accordingly, the 5-laser guideline projection system 240 may include five laser devices which emit laser beams 244*a*, 244*b*, 244*c*, 244*d*, 244*e*, respectively. FIG. 16 and FIG. 17 show the laser beams 244*a*, 244*b*, 244*c*, 244*d*, 244*e* with respect to the conduit 190.

Figure 19:
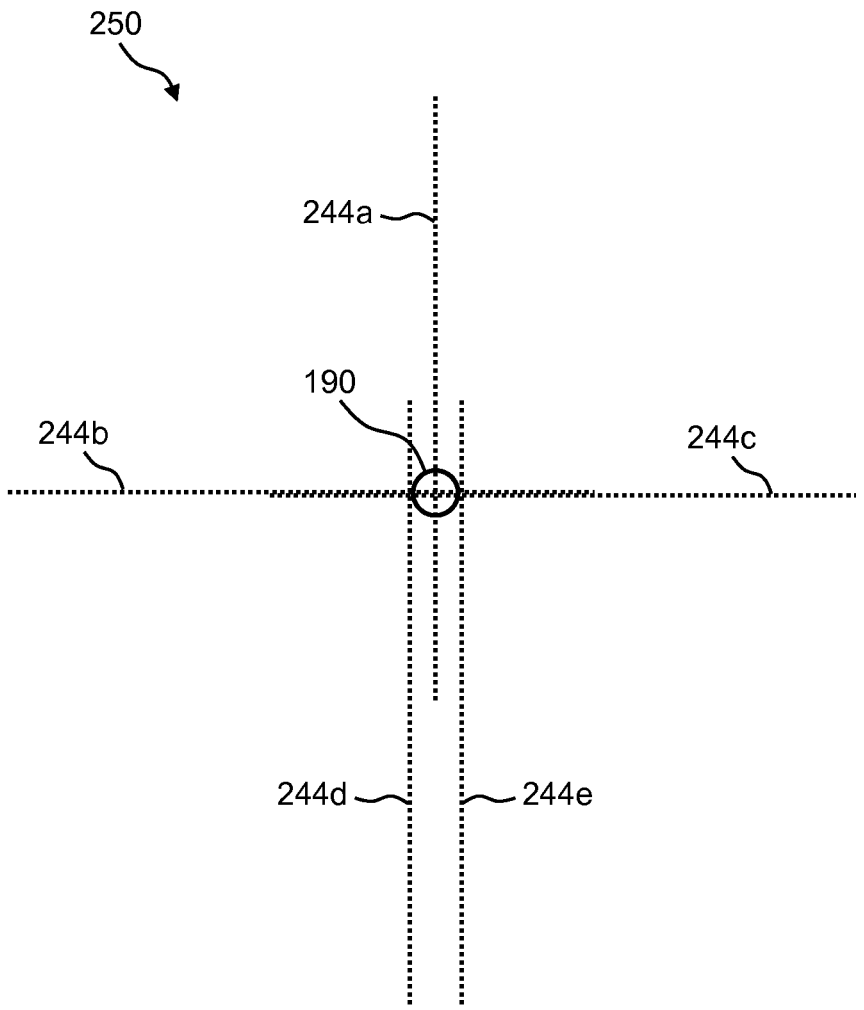
FIG. 19 shows an example of a pattern of projected guidelines of the angle-indicating tube bender shown in FIG. 6 through FIG. 8.

Additionally, FIG. 19 shows a front view of an exemplary beam pattern 250, which shows the pattern of laser beams 244*a*, 244*b*, 244*c*, 244*d*, 244*e* with respect to the conduit 190. In beam pattern 250, the plane of the laser beam 244*a* substantially corresponds to the vertical plane running through the center of the conduit 190. The plane of laser beams 244*b* and 244*c* substantially correspond to the horizontal plane running through the center of the conduit 190. The planes of the laser beams 244*b* and 244*c* overlap to essentially form a single long guiding line or marker. The plane of the laser beam 244*d* is substantially parallel to the vertical plane running through the center of the conduit 190 but positioned to one side of the conduit 190. The plane of the laser beam 244*e* is also substantially parallel to the vertical plane running through the center of the conduit 190 but positioned to the other side of the conduit 190.

The purpose of projecting the beam pattern 250 is to provide an accurate guide or marker for orienting an existing bend in the conduit 190 with respect to the next bend to be made in the conduit 190. For example, the user rotates the conduit 190 such that the existing bend aligns with one of the beams of the beam pattern 250, such as with the laser beam 244*a* or with the laser beams 244*b*, 244*c*. In some scenarios, the laser beam 244*a* may be blocked by a bend in the conduit 190. In this case, the conduit 190 can be aligned between the laser beams 244*d*, 244*e*. That is, when the conduit 190 is between the laser beams 244*d*, 244*e* while at the same time neither laser beam 244*d*, 244*e* is showing on the conduit 190, the conduit 190 is properly positioned for bending. Using the beam pattern 250, it can be ensured that the next bend to be formed is accurately aligned with or accurately 90 degrees out of phase with an existing bend in the conduit 190. In other words, the beam pattern 250 is used to ensure the accuracy of one bend with respect to another bend.

Figure 20:
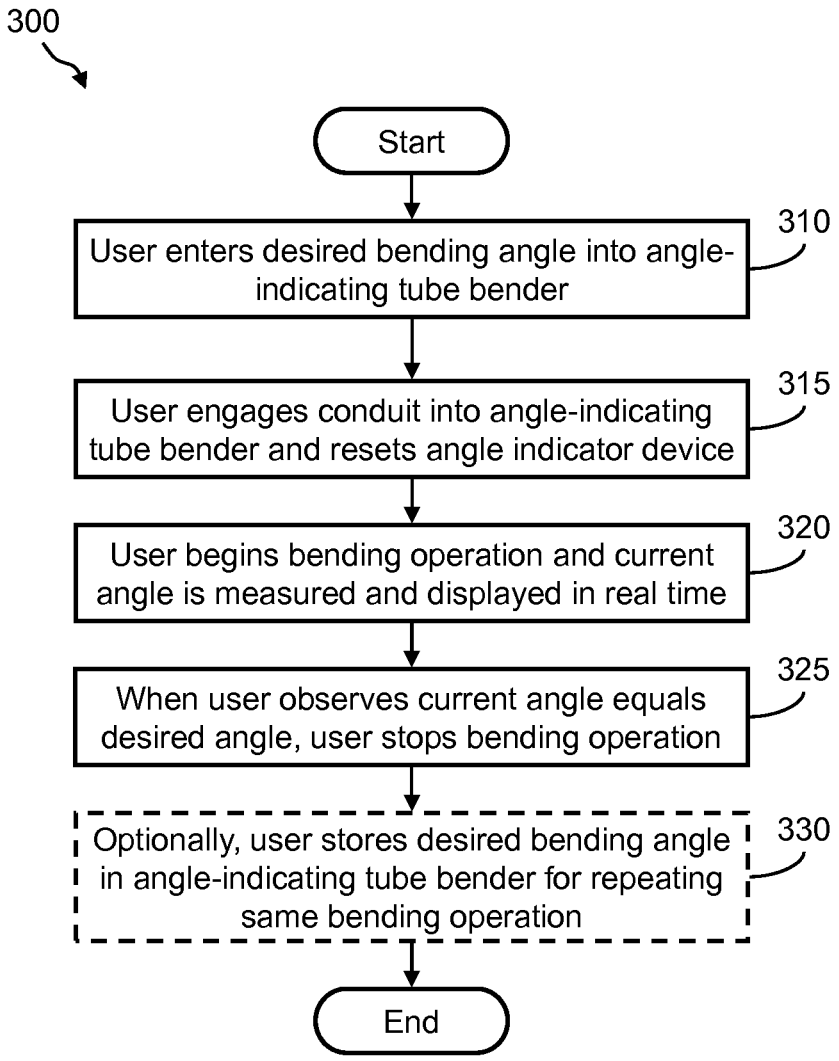
FIG. 20 illustrates a flow diagram of an example of a method of using the presently disclosed angle-indicating tube bender.

Referring now to FIG. 20, a flow diagram of an example of a method 300 is shown that uses the presently disclosed angle-indicating tube bender 100/200. The method 300 may include, but is not limited to, the following steps.

At a step 310, the user enters the desired bending angle $\alpha$ using user controls 134 of the angle indicator device 130. In one example, the user enters 38 degrees.

At a step 315, the user engages the conduit 190 into the receiving end 116/216 of the cradle 112/212 of the angle-indicating tube bender 100/200. The user then resets the angle indicator device 130 by pressing the ZERO button.

At a step 320, the user begins bending the conduit 190. In real time, the angle indicator device 130 measures the angle $\alpha$ and displays the current angle $\alpha$ to the user via the digital display 132 of the angle-indicating tube bender 100/200.

At a step 325, when the user observes that the current angle $\alpha$ is at 38 degrees (as an example), which is the angle set in step 310, the user stops the bending operation. In another example, a beeping sound is generated via the audio output 136 when 38 degrees is reached, which prompts the user to stop the bending operation. In yet another example, a visual indicator (e.g., an LED) is turned on or the digital display 132 starts to blink when 38 degrees is reached, which prompts the user to stop the bending operation. In yet another example, a vibration may be induced in the handle upon reaching 38 degrees, similarly prompting the user to stop the bending operation.

At an optional step 330, if the user intends to repeat the same bending operation, using user controls 134 the user may store a certain desired bending angle $\alpha$, such as the 38 degrees, into the angle-indicating tube bender 100/200. In another example, the angle indicator device 130 automatically stores the last angle entered or reached.

The angle-indicating tube bender 100 described with reference to FIG. 1 through FIG. 5 and/or the angle-indicating tube bender 200 described with reference to FIG. 6 through FIG. 18 can include certain control electronics. For example, FIG. 21, FIG. 22, and FIG. 23 show block diagrams of various exemplary configurations of control electronics 400 for use in the angle-indicating tube bender 100 and/or the angle-indicating tube bender 200.

Figure 21:
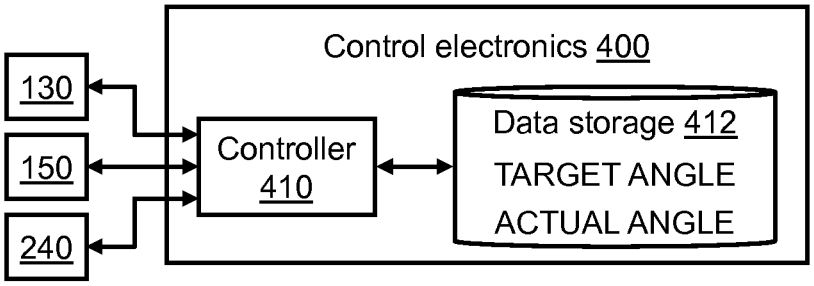
FIG. 21, FIG. 22, and FIG. 23 show block diagrams of various configurations of control electronics for use in the presently disclosed angle-indicating tube benders.

Referring now to FIG. 21, a first and simplest configuration of the control electronics 400 is shown. In this configuration, the control electronics 400 may include a controller 410. In the angle-indicating tube bender 100, the controller 410 may be used to manage the overall operations of the angle indicator device 130 and/or the guideline projection mechanism 150. In the angle-indicating tube bender 200, the controller 410 may be used to manage the overall operations of the angle indicator device 130 and/or the 5-laser guideline projection system 240. The controller 410 can be any standard controller or microprocessor device that is capable of executing program instructions. A certain amount of data storage 412 may be associated with the controller 410. In one example, a TARGET ANGLE value and an ACTUAL ANGLE value are stored in the data storage 412.

Figure 22:
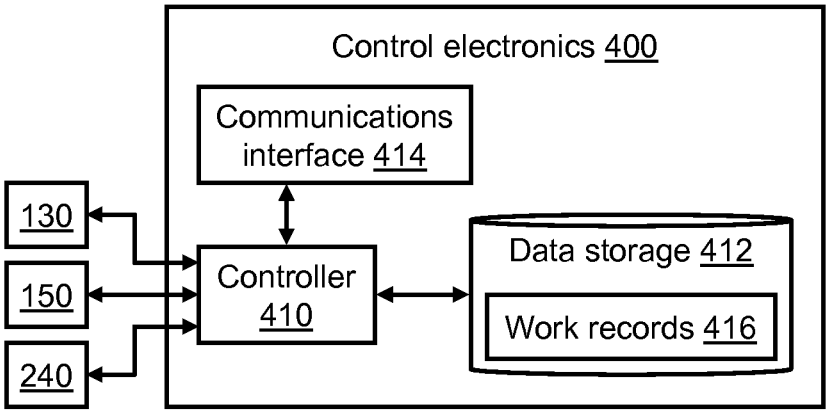
Figure 23:
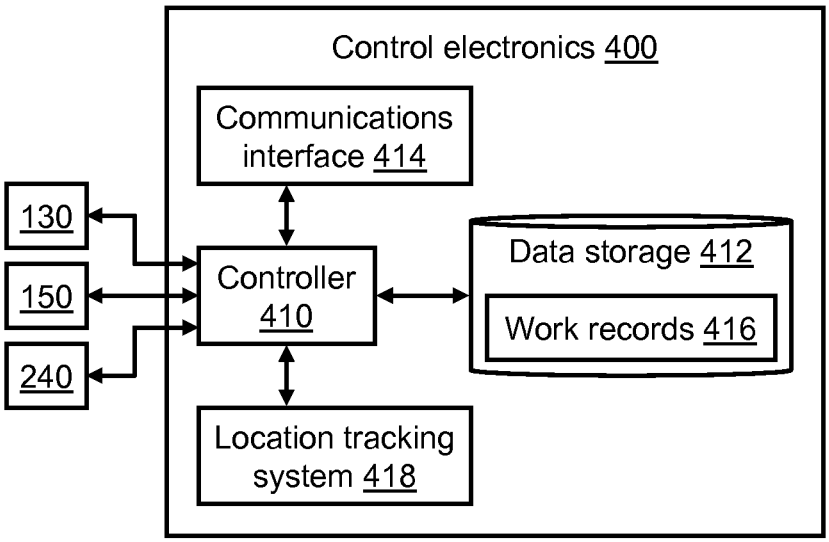

Referring now to FIG. 22, another exemplary configuration of the control electronics 400 is shown. In this configuration, the control electronics 400 may include the controller 410, the data storage 412, and may further include a communications interface 414. The communications interface 414 may be any wired and/or wireless communication interface for connecting to a network (not shown) and by which information may be exchanged with other devices connected to the network. Examples of wired communication interfaces may include, but are not limited to, USB ports, RS232 connectors, RJ45 connectors, Ethernet, and any combinations thereof. Examples of wireless communication interfaces may include, but are not limited to, an Intranet connection, Internet, ISM, Bluetooth® technology, Bluetooth® Low Energy (BLE) technology, Wi-Fi, Wi-Max, IEEE 502.11 technology, ZigBee technology, Z-Wave technology, 6LoWPAN technology (i.e., IPv6 over Low Power Wireless Area Network (6LoWPAN)), ANT or ANT+ (Advanced Network Tools) technology, radio frequency (RF), Infrared Data Association (IrDA) compatible protocols, Local Area Networks (LAN), Wide Area Networks (WAN), Shared Wireless Access Protocol (SWAP), any combinations thereof, and other types of wireless networking protocols.

Examples of information facilitated by the communications interface 414 include the transmission of work records 416 that may be stored in the data storage 412. Each work record 416 can include any information about a "bend event." For example, a work record 416 can include a timestamp, a contractor ID, a job ID, a job address, a TARGET ANGLE value, an ACTUAL ANGLE value, and the like.

Referring now to FIG. 23, yet another exemplary configuration of the control electronics 400 is shown. In this configuration, the control electronics 400 includes the controller 410, the data storage 412, the communications interface 414, and may further include a location tracking system 418. The location tracking system 418 of the control electronics 400 may include any device that can determine its geographical location to a certain degree of accuracy. For example, the location tracking system 418 may include a GPS receiver, such as a global navigation satellite system (GNSS) receiver. A GPS receiver may provide, for example, any standard format data stream, such as a National Marine Electronics Association (NMEA) data stream. The location tracking system 418 may also include an error correction component (not shown), which may be any mechanism for improving the accuracy of the geo-location data. In another embodiment, the location tracking system 418 may include any device or mechanism that may determine location by any other means, such as by performing triangulation (e.g., triangulation using cellular radiotelephone towers).

In this configuration, a work record 416 can include a timestamp, a contractor ID, a job ID, a job address, a TARGET ANGLE value, an ACTUAL ANGLE value, geo-location data (e.g., GPS coordinates), and the like.

Any configuration of the control electronics 400 can be implemented on a printed circuit board (PCB) inside, for example, compartment 232 in the housing portions 220, 222 of the angle-indicating tube bender 200. Note, however, that any other housing configuration may also suffice.

Figure 24:
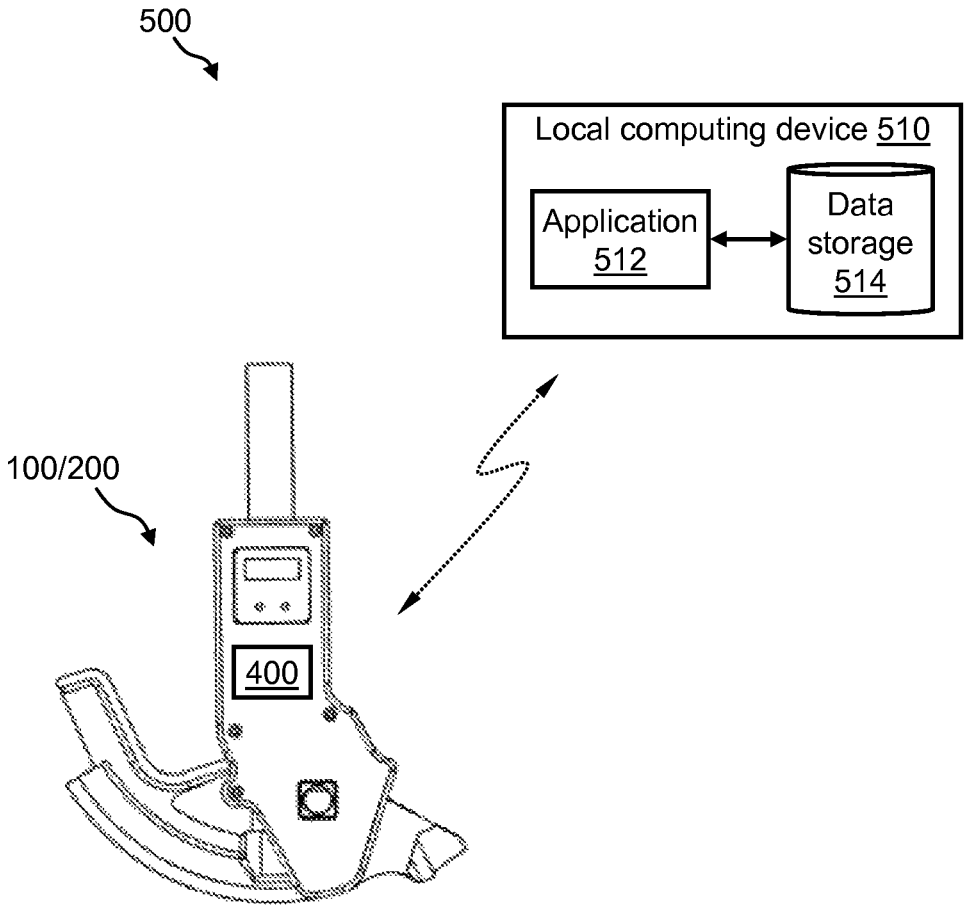
FIG. 24 and FIG. 25 illustrate block diagrams of examples of tube bender systems for processing information from the presently disclosed angle-indicating tube benders.

Referring now to FIG. 24, a block diagram of an example of a tube bender system 500 is shown. In this example, the tube bender system 500 includes the angle-indicating tube bender 100 or the angle-indicating tube bender 200 and a local computing device 510. The local computing device 510 can be, for example, a desktop computer, a laptop computer, a handheld computing device, a personal digital assistant (PDA), a tablet device, a mobile phone (e.g., a smart phone), and the like. In one example, the computing device 510 is Bluetooth®-enabled and/or Wi-Fi-enabled for communicating wirelessly with the angle-indicating tube bender 100/200 or with any other local devices or networks.

An application 512 and data storage 514 may reside at the computing device 510. The application 512 can be any desktop application or mobile app that is designed to receive and process any information received from the angle-indicating tube bender 100/200, wherein the information can be any information about "bend events" performed using the angle-indicating tube bender 100/200. This information may be stored at data storage 514.

Figure 25:
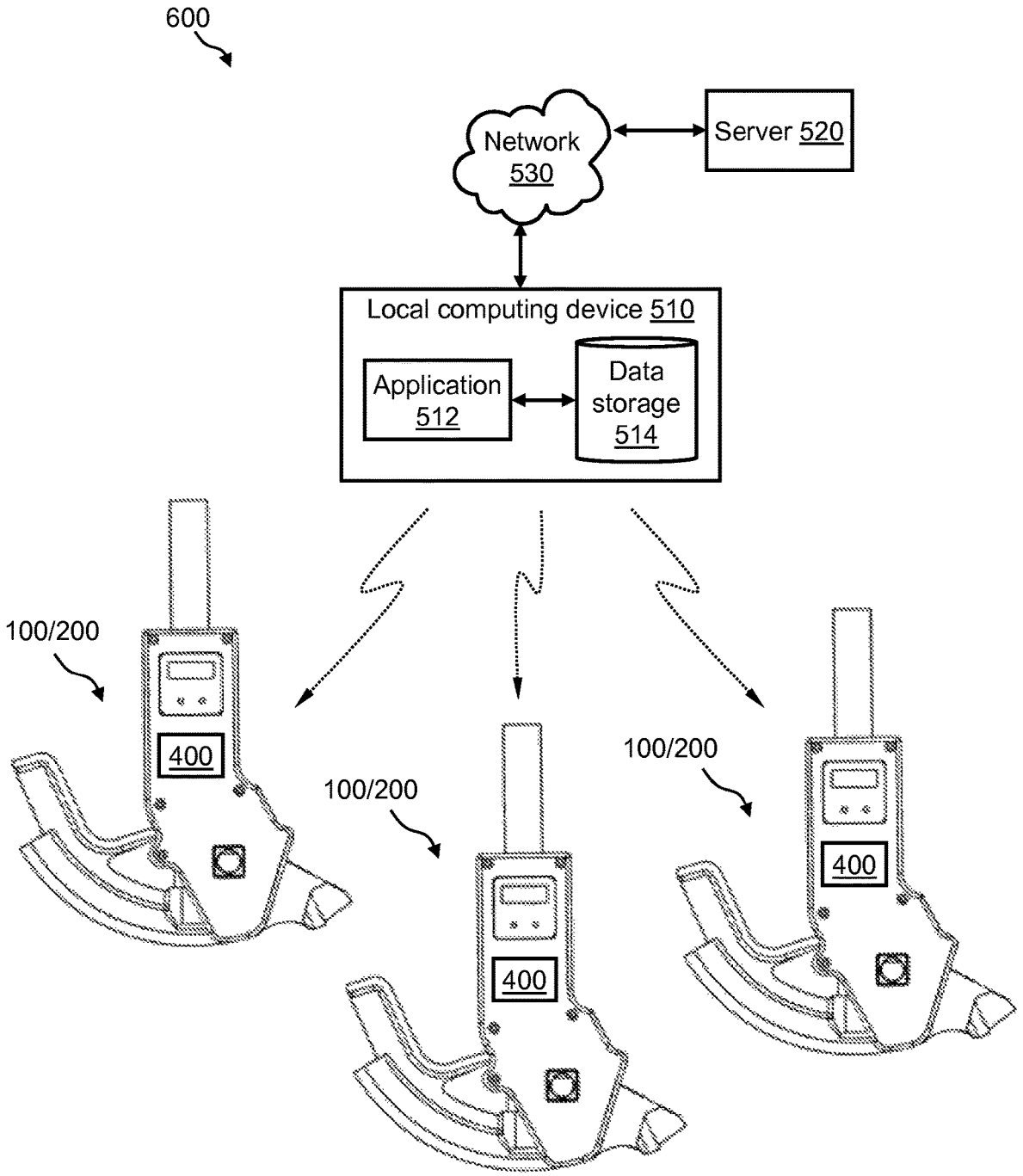

Referring now to FIG. 25, a block diagram of another example of a tube bender system is shown; namely, a tube bender system 600. In this example, the tube bender system 600 includes a network of multiple angle-indicating tube benders 100/200 in communication with one or more local computing devices 510. Further, the local computing device(s) 510 can communicate with a centralized computing device, such as a server 520. Namely, the local computing device(s) 510 may communicate with the server 520 via a network 530. The network 530 can be any network for providing wired or wireless connection to the Internet, such as a local area network (LAN), a wide area network (WAN), and/or a cellular or other mobile network. The server 520 can be, for example, a cloud-based server.

Generally, the tube bender system 500 of FIG. 24 and the tube bender system 600 of FIG. 25 can be used to process any information from the presently disclosed angle-indicating tube benders 100/200.

Figure 26:
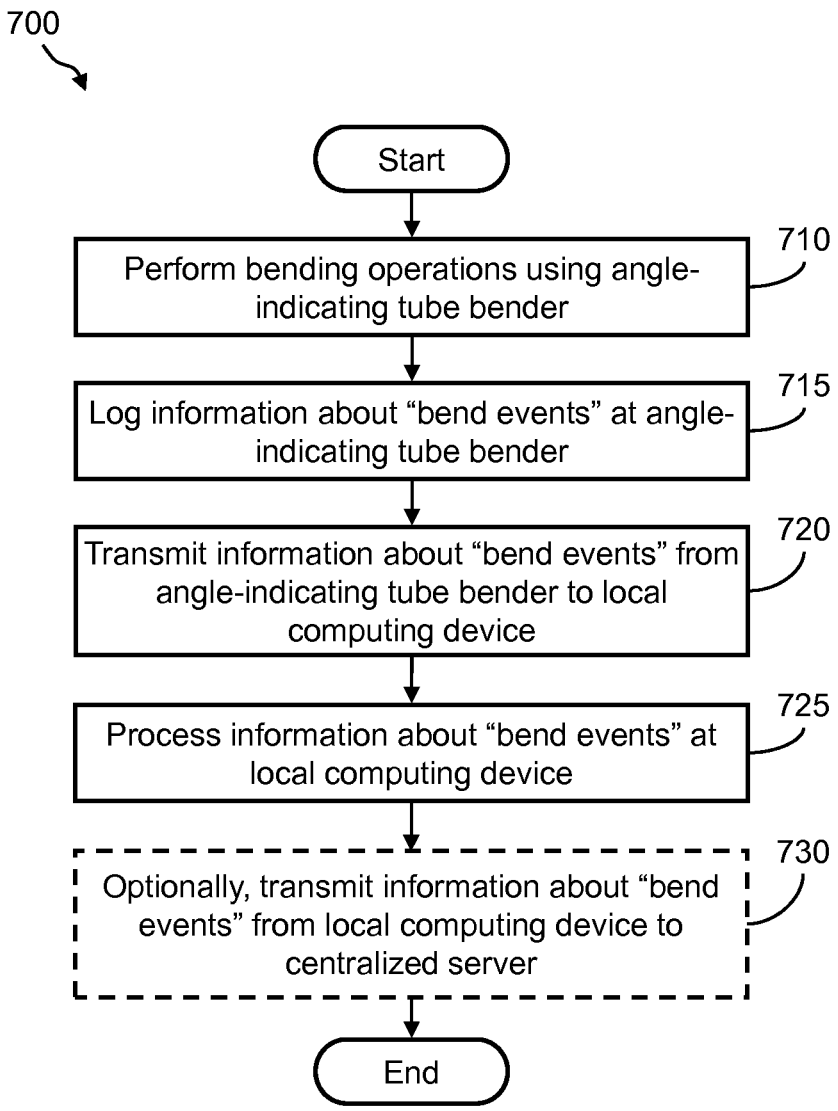
FIG. 26 illustrates a flow diagram of an example of a method of using the tube bender systems.

Referring now to FIG. 26, an example of a method 700 of using the tube bender system 500 of FIG. 24 and/or the tube bender system 600 of FIG. 25 is shown. The method 700 may include, but is not limited to, the following steps.

At a step 710, bending operations are performed using the angle-indicating tube bender 100/200.

At a step 715, under the control of control electronics 400, information about "bend events" is logged in data storage 413 at the angle-indicating tube bender 100/200.

At a step 720, under the control of control electronics 400, information about "bend events" is transmitted from the angle-indicating tube bender 100/200 to the local computing device 510.

At a step 725, information about "bend events" is received and processed by the local computing device 510.

At an optional step 730, information about "bend events" is transmitted from the local computing device 510 to a centralized computing device, such as server 520.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, parameters, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments, ±100% in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the subject matter.

That which is claimed:

1. An angle-indicating tube bender apparatus, the apparatus comprising: a tube bending portion and an angle indicator device, wherein the tube bending portion further comprises a head, a curved cradle comprising a receiving end configured to receive and engage a tube or conduit to be bent, and a handle; and further comprising a guideline projection mechanism configured to project guidelines for aiding a user in alignment of the tube or conduit to be bent wherein the guidelines are projected in a cross-hair pattern.

2. The apparatus of claim 1, wherein the angle indicator device comprises a display for displaying a measured angle.

3. The apparatus of claim 1, wherein the angle indicator device further comprises user controls.

4. The apparatus of claim 3, wherein the user controls can receive an input from a user of a desired bend angle.

5. The apparatus of claim 4, wherein the angle indicator device comprises an angle alert mechanism.

6. The apparatus of claim 5, wherein the angle alert mechanism alerts a user upon reaching the desired bend angle.

7. The apparatus of claim 5, wherein the angle alert mechanism comprises at least one of a speaker for audible alerts, a light source for a visual alert, or a vibration source for a tactile alert.

8. The apparatus of claim 1, wherein the tube bending portion further comprises a housing, and further wherein the angle indicator device is installed within the housing.

9. The apparatus of claim 8, wherein the housing further comprises one or more openings for accessing the angle indicator device.

10. The apparatus of claim 1, wherein the guideline projection mechanism comprises one or more lasers configured to project the guidelines.

11. The apparatus of claim 1, wherein the angle indicator device further comprises control electronics, and further wherein the control electronics comprise at least one of a communications interface, a controller, or data storage.

12. A method of using an angle-indicating tube bender apparatus, the method comprising the steps of:

a. providing an angle-indicating tube bender apparatus comprising: a tube-bending portion and an angle indicator device, wherein the tube bending portion further comprises a head, a curved cradle comprising a receiving end configured to receive and engage a tube or conduit to be bent, and a handle; and further comprising a guideline projection mechanism configured to project guidelines for aiding a user in alignment of the tube or conduit to be bent wherein the guidelines are projected in a cross-hair pattern;

b. inserting a tube or conduit to be bent into a tube-bending portion of the apparatus;

c. bending the tube or conduit to be bent while the angle indicator device displays a bend angle in real time;

d. continuing to bend the tube or conduit to be bent until the angle indicator device displays a desired bend angle; and e. ceasing bending operations and removing the tube or conduit from the apparatus.

13. The method of claim 12, wherein a user enters the desired bend angle into the angle indicator device prior to commencing the bend, and further wherein the angle indicator device comprises an angle alert component that signals the user to cease bending operation upon reaching the desired bend angle.

14. The method of claim 13, wherein the angle alert component comprises one or more of an audible alert, a visual alert, or a tactile alert.

15. The method of claim 12, wherein the angle indicator device stores information about bend events in control electronics for later reference by the user.

16. The method of claim 15, wherein the control electronics comprise a communications interface and information about prior bend events is communicated to one or more local computing devices.

17. The method of claim 16, wherein the one or more local computing devices communicate information about prior bend events to a server via a network.

* * * * *